United States Patent [19]

Olson

[11] Patent Number: 4,934,346

[45] Date of Patent: Jun. 19, 1990

[54] SIDEWALL CYLINDER ENTRAPMENT VALVE FOR INTERNAL COMBUSTION CHAMBER

[75] Inventor: Jeffrey A. Olson, Mundelein, Ill.

[73] Assignee: Outboard Marine Corporation, Waukegan, Ill.

[21] Appl. No.: 377,109

[22] Filed: Jul. 10, 1989

[51] Int. Cl.[5] ..... F02M 67/04

[52] U.S. Cl. ..... 123/73 C; 123/316; 123/532

[58] Field of Search ..... 123/73 C, 73 GB, 73 CC, 123/532, 316; 417/380

[56] References Cited

U.S. PATENT DOCUMENTS

| | | | |
|---|---|---|---|
| 1,551,731 | 9/1925 | Charter | 123/532 |
| 3,800,754 | 4/1974 | Carlson et al. | 123/73 CB |
| 4,141,675 | 2/1979 | O'Neill | 417/380 |
| 4,471,728 | 9/1984 | Borst et al. | 123/73 R |
| 4,599,983 | 7/1986 | Omachi | 123/497 |
| 4,627,390 | 12/1986 | Antoine | 123/73 CB |
| 4,765,304 | 8/1988 | Brown | 123/73 CB |
| 4,829,958 | 5/1989 | Duret | 123/316 |

*Primary Examiner*—David A. Okonsky

*Attorney, Agent, or Firm*—Michael, Best & Friedrich

[57] ABSTRACT

The invention provides an internal combustion engine comprising a cylinder having a head end and adapted to have air and fuel combusted therein and a piston reciprocate therein relative to the head end, an exhaust port adapted to conduct combusted air and fuel from the cylinder, structure defining an accumulation chamber, a passageway communicating with the accumulation chamber and with the cylinder at a predetermined position located between the exhaust port and the top dead center position, and structure for blocking the passageway in response to travel of the piston toward the head end and to passage of at least a portion of the piston over the predetermined position, so that the accumulation chamber is substantially prevented from receiving combusted air and fuel when the piston travels away from the head end.

13 Claims, 1 Drawing Sheet

SIDEWALL CYLINDER ENTRAPMENT VALVE FOR INTERNAL COMBUSTION CHAMBER

BACKGROUND OF THE INVENTION

The invention relates generally to internal combustion engines. More particularly, the invention relates to systems for accumulating compressed gas from a cylinder of an internal combustion engine.

The invention also relates to arrangements for creating a source of compressed gas which can be mixed with fuel and injected into a spark ignited internal combustion engine.

Attention is directed to U.S. patent application Ser. No. 159,661, filed Feb. 24, 1988, and to a recently filed U.S. patent application entitled "A Cylinder Entrapment System with an Air Spring," assigned to Outboard Marine Corporation, both of which relate to systems for accumulating compressed gas from a cylinder of an internal combustion engine.

Attention is also directed to U.S. Pat. No. 1,551,731, which issued on Sept. 1, 1925 and which relates to a passage and valve in a sidewall of an engine block and supplying air to a plenum, and to Brown, U.S. Pat. No. 4,765,304, which issued on Aug. 23, 1988, which relates to an internal combustion engine with a compressed air collection system, and which includes ducts communicating between a cylinder and a storage tank, and passing through a sidewall of the cylinder.

SUMMARY OF THE INVENTION

The invention provides an internal combustion engine comprising a cylinder having a head end and adapted to have air and fuel combusted therein and a piston reciprocate therein relative to the head end, an exhaust port adapted to conduct combusted air and fuel from the cylinder, means defining an accumulation chamber, a passageway communicating with the accumulation chamber and with said cylinder at a predetermined position located between the exhaust port and the top dead center position, and means for blocking the passageway in response to travel of the piston toward the head end and to passage of at least a portion of the piston over the predetermined position, and for causing said passageway to remain blocked, while the piston travels away from said head end and said predetermined position, until pressure in said cylinder falls below a predetermined pressure.

In one aspect of the invention, an internal combustion engine is provided comprising an engine block, a cylinder defined in the engine block, having a head end, adapted to have air and fuel combusted therein, and adapted to have a piston reciprocate therein relative to the head end, an exhaust port adapted to conduct combusted air and fuel from the cylinder, means defining an accumulation chamber, for accumulating pressurized air, a passageway extending between the cylinder and the accumulation chamber for supplying air from the cylinder to said accumulation chamber, having a first portion communicating with the accumulation chamber, and having a second portion communicating with the cylinder at a location between the exhaust port and the head end, and means for blocking the first portion of the passageway in response to travel of the piston toward the head end and to passage of at least a portion of the piston over the second portion of the passageway.

In another aspect of the invention, an internal combustion engine is provided comprising an engine block having a sidewall, a cylinder defined by the engine block, having a head end, adapted to have air and fuel combusted therein, and adapted to have a piston reciprocate therein relative to the head end, an exhaust port located in the sidewall, for conducting combusted air and fuel from the cylinder, an accumulation chamber at least partially defined by the sidewall, a space at least partially defined by the sidewall, a passageway extending between the accumulation chamber and the cylinder and including a first portion defining a portion of the space and communicating with the accumulation chamber, and a second portion communicating between the first portion of the passageway and the cylinder at a location between the exhaust port and the head end, a valve located in the first portion of the passageway and operable between an open position and a closed position, a second passageway communicating between the space and the cylinder, at a location proximate the head end, and a control piston in the space, restricting fluid flow from the second passageway to the first portion of the first mentioned passageway, and connected to the valve for common movement therewith to cause the valve to move to the closed position in response to a higher pressure in the second passageway than in the first mentioned passageway, and means for biasing the valve from the closed position to the open position so that the valve is located in the open position when the pressure in the second passageway is approximately equal to the pressure in the first mentioned passageway.

Figure 1:
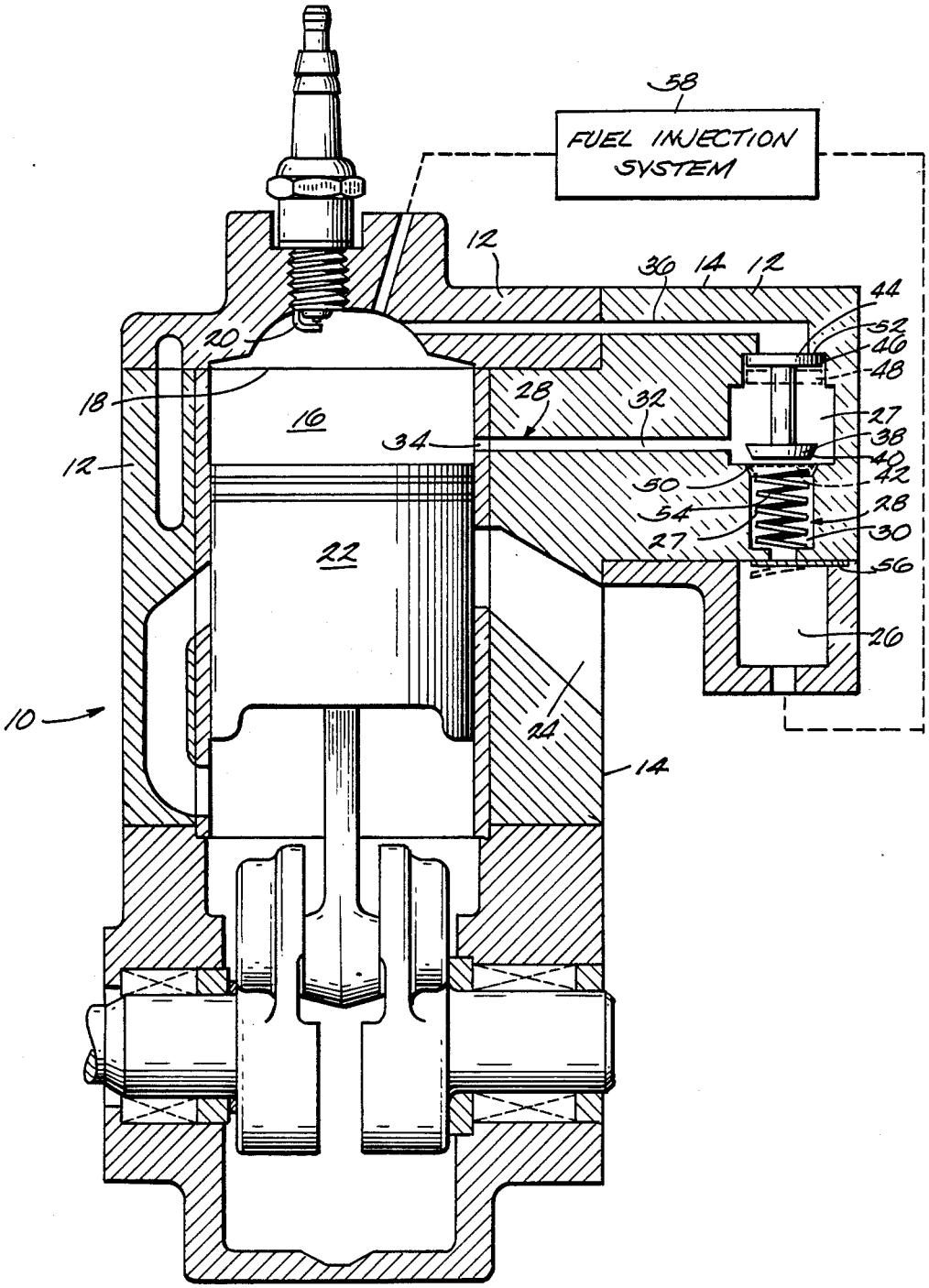
FIG. 1 is a fragmentary sectional view of an engine block embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is an internal combustion engine 10 including an engine block 12 having a sidewall 14.

A cylinder 16 is defined by the engine block 12, and has a head end 18. The cylinder 16 is adapted to have air and fuel combusted therein. More particularly, the cylinder is adapted to receive a spark plug 20, proximate the head end, for igniting the air and fuel. The cylinder 16 is adapted to have a piston 22 reciprocate therein relative to the head end 18.

The internal combustion engine 10 further includes at least one exhaust port 24 in the sidewall 14, and adapted to conduct combusted air and fuel from cylinder 16.

The internal combustion engine 10 further includes means defining an accumulation chamber 26 for accumulating pressurized air. While various constructions can be employed, in the illustrated embodiment, the accumulation chamber 26 is at least partially defined by the engine block 12, and more particularly, by the sidewall 14.

The internal combustion engine 10 further includes a passageway 28 between the cylinder 16 and the accumulation chamber 26, which passageway is adapted to supply air from the cylinder 16 to the accumulation chamber 26. The passageway 28 has a first portion 30 communicating with the accumulation chamber 26, and a second portion 32 communicating with the cylinder 16 at a location 34 between the exhaust port 24 and the head end 18.

The internal combustion engine 10 further comprises means including the first portion 30 of the passageway 28 defining an area, or space, or chamber 27 accommodating a valve 38 still to be described. While various other constructions can be employed, in the illustrated embodiment, the chamber 27 is at least partially defined by the engine block 12, and more particularly, by the sidewall 14.

The internal combustion engine 10 further includes means for blocking the first portion 30 of the passageway 28 in response to travel of the piston 22 toward the head end 18 and to passage of at least a portion of the piston 22 over the second portion of the passageway 28. While various other blocking means could be employed, in the illustrated embodiment this blocking means comprises a second passageway 36 communicating with the cylinder 16 at a location proximate the head end 18, and with the area or space 27. The blocking means further comprises a valve 38 operable in the first portion 30 of the first mentioned passageway 28 between an open position 40 (shown in solid outline), and a closed position 42 (shown in dotted outline). .The blocking means further comprises means for moving the valve 38 to the closed position 42 in response to travel of the piston 22 toward the head end 18 and to passage of at least a portion of the piston 22 over the second portion 32 of the first mentioned passageway 28 at the location 34.

While various other constructions could be employed, in the illustrated embodiment, the moving means comprises a control piston 44 which is located in the area or space 27, and which restricts (either partially or completely) fluid flow from the second passageway 36 to the first portion 30 of the first mentioned passageway 28. The control piston 44 is movable between a first position 46 (shown in solid outline) associated with location of the valve 38 in the open position 40, and a second position 48 (shown in the dotted outline) associated with location of the valve 38 in the closed position 42. The control piston 44 is connected to the valve 38 for common movement with the valve 38 to cause the valve 38 to move to the closed position 42 in response to travel of the piston 22 toward the head end 18 and to passage of at least a portion of the piston 22 over the second portion 32 of the first mentioned passageway 28, which passage and travel causes higher pressure in the second passageway 36 than in the first mentioned passageway 28 thereby causing movement of the control piston 44 to the second position 48.

The area or space 27 includes a valve seat 50 engaged by the valve 38 when the valve is in the closed position 42, and a piston stop 52 engaged by the control piston 44 when the control piston is in the first position 46.

The internal combustion engine 10 further includes means for biasing the valve 38 from the closed position 42 to the open position 40 and so that the valve 38 is disposed in the open position 40 when pressure in the second passageway 36 is approximately equal to the pressure in the first mentioned passageway 28. While various other constructions can be employed, the biasing means comprises a spring 54 located in the first portion 30 of the first mentioned passageway 28, and biasing the valve 38 toward the open, position 40.

The internal combustion engine 10 further includes means for allowing flow from the first portion 30 of the first mentioned passageway 28 to the accumulation chamber 26, and for substantially preventing flow from the accumulation chamber 26 to the first portion 30 of the first mentioned passageway 28. While various other constructions could be employed, in the illustrated embodiment, this means comprises a reed check valve 56.

The internal combustion engine 10 further includes a fuel injection system 58 communicating with the accumulation chamber 26 and the cylinder 16 and adapted to selectively supply at least air from the accumulation chamber to the cylinder 16.

In operation the internal combustion engine 10 operates as follows.

Assume that the piston 22 is moving toward the head end 18 from the position shown in FIG. 1. Pressure in the cylinder 16 increases, and pressure on the control piston 44 from the first mentioned passageway 28 is generally equal to pressure on the control piston 44 from the second passageway 36. The spring 54 biases the valve 38 to the open position 40 and thereby biases the control piston 44 to the first position 46, against the piston stop 52. Pressurized air flows from the cylinder 16 to the accumulation chamber 26 via the first mentioned passageway 28. The reed check valve 56 substantially prevents flow from the accumulation chamber 26 to the cylinder 16 via the first mentioned passageway 28. The piston 22 will eventually cover or close the passageway 28 at the location 34, without covering or closing the second passageway 36, thereby substantially preventing flow from the cylinder into the passageway 28 so that pressure on the control piston 44 from the second passageway 36 is greater than pressure on the control piston 44 from the second portion 32 of the first mentioned passageway 28. This pressure differential causes the control piston 44 to move to the second position 48, thereby causing the valve 38 to move to the closed position 42, against the valve seat 50.

Combustion in the cylinder 16 proceeds normally and the piston 22 begins to travel away from the head end 18, and eventually uncovers the second portion 32 of the passageway 28 at the location 34. As a consequence, the pressure on the control piston 44 from the second portion 32 of the first mentioned passageway 28 is generally equal to pressure on the control piston 44 from the second passageway 36. Notwithstanding, the valve 38 remains in the closed position 42 because force produced by pressure in the cylinder 16 tends to displace the valve 38 to the closed position 42, and is much greater than the sum of the force produced by the spring 54 and the force produced by the pressure in the first portion 30 of the passageway 28, which forces bias the valve 38 toward the open position 40. The valve 38 does not move to the open position 40 until approximately just before the exhaust port 24 opens and pressure in the cylinder 16 has decreased to a pressure slightly greater than the pressure in the accumulation chamber 26.

The piston, after reaching bottom dead center, again begins to travel toward the head end 18, and, with the valve 38 open, gas again flows into and accumulates in the accumulation chamber 26.

After a sufficient number of such cycles, the accumulation chamber 26 will be charged to a pressure determined by the location 34. More particularly, maximum pressure in the accumulation chamber 26 will approximate the pressure in the cylinder 16 when the piston 22, during travel toward the head end 18, covers the second portion 32 of the first mentioned passageway 28 at the location 34. The location 34 should be selected sufficiently far from the head end 18 so that, during piston travel toward the head end 18, the passageway 28 is covered by the piston 22 before combustion commences in the cylinder 16 and so that, in general, non-combusted air is accumulated in the accumulation chamber 26.

Various of the features of the invention are set forth in the following claims.

I claim:

1. An internal combustion engine comprising a cylinder having a head end and adapted to have air and fuel combusted therein and a piston reciprocate therein relative to said head end, an exhaust port adapted to conduct combusted air and fuel from said cylinder, means defining an accumulation chamber, a passageway communicating with said accumulation chamber and with said cylinder at a predetermined position located between said exhaust port and the top dead center position, and means for blocking said passageway in response to travel of the piston toward said head end and to passage of at least a portion of the piston over said predetermined position, and for causing said passageway to remain blocked, while the piston travels away from said head end and said predetermined position, until pressure in said cylinder falls below a predetermined pressure.

2. An internal combustion engine comprising an engine block, a cylinder defined in said engine block, having a head end, adapted to have air and fuel combusted therein, and adapted to have a piston reciprocate therein relative to said head end, an exhaust port adapted to conduct combusted air and fuel from said cylinder, means defining an accumulation chamber for accumulating pressurized air, a passageway extending between said cylinder and said accumulation chamber for supplying air from said cylinder to said accumulation chamber, having a first portion communicating with said accumulation chamber, and having a second portion communicating with said cylinder at a location between said exhaust port and said head end, and means for blocking said first portion of said passageway in response to travel of the piston toward said head end and to passage of at least a portion of the piston over said second portion of said passageway.

3. An internal combustion engine in accordance with claim 2 wherein said passage includes an area, and wherein said blocking means comprises a second passageway communicating with said area and with said cylinder at a location proximate said head end, a valve operable in said first portion of said first mentioned passageway between an open position and a closed position, and means for moving said valve to the closed position in response to travel of the piston toward said head end and to passage of at least a portion of the piston over said second portion of said passageway.

4. An internal combustion engine in accordance with claim 3 wherein said means defining said area is at least partially defined by said engine block.

5. An internal combustion engine in accordance with claim 3 wherein said means defining said area is at least partially defined by said engine block.

6. An internal combustion engine in accordance with claim 3 wherein said moving means comprises a control piston in said area, movable between a first position associated with location of said valve in the open position, and a second position associated with location of said valve in the closed position, restricting fluid flow from said second passageway to said first portion of said first mentioned passageway, and connected to said valve for common movement therewith to cause said valve to move to the closed position in response to travel of the piston toward said head end and in response to passage of at least a portion of the piston over said second portion of said passageway, which passage and travel causes higher pressure in said second passageway than in said first mentioned passageway and thereby moves said control piston to the second position.

7. An internal combustion engine in accordance with claim 6 wherein said area includes a valve seat engaged by said valve when said valve is in the closed position, and a piston stop engaged by said control piston when said control piston is in the first mentioned position.

8. An internal combustion engine in accordance with claim 7 and further including means for biasing said valve from the closed position to the open position and so that said valve is disposed in said open position when the pressure in said second passageway is approximately equal to the pressure in said first mentioned passageway.

9. An internal combustion engine in accordance with claim 8 wherein said biasing means comprises a spring located in said first portion of said first mentioned passageway and biasing said valve toward said open position.

10. An internal combustion engine in accordance with claim 3 and further including means for allowing flow from said first portion of said first mentioned passageway to said accumulation chamber and for substantially preventing flow from said accumulation chamber to said first portion of said first mentioned passageway.

11. An internal combustion engine in accordance with claim 10 wherein said means for allowing flow from said first mentioned portion of said first mentioned passageway to said accumulation chamber and for substantially preventing flow from said accumulation chamber to said first mentioned portion of said first mentioned passageway comprises a check valve.

12. An internal combustion engine in accordance with claim 3 and further including a fuel injection system communicating between said accumulation chamber and said cylinder and adapted to selectively supply at least air from said accumulation chamber to said cylinder.

13. An internal combustion engine comprising an engine block having a sidewall, a cylinder defined by said engine block, having a head end, adapted to have air and fuel combusted therein, and adapted to have a piston reciprocate therein relative to said head end, an exhaust port located in said sidewall for conducting combusted air and fuel from said cylinder, an accumulation chamber at least partially defined by said sidewall, a space at least partially defined by said sidewall, a passageway extending between said accumulation chamber and said cylinder and including a first portion defining a portion of said space and communicating with said accumulation chamber, and a second portion communicating between said first portion of said passageway and said cylinder at a location between said exhaust port and said head end, a valve located in said first portion of said passageway and operable between an open position and a closed position, a second passageway communicating between said space and said cylinder at a location proximate said head end, a control piston located in said space, restricting fluid flow from said second passageway to said first portion of said first mentioned passageway, and connected to said valve for common movement therewith to cause said valve to move to the closed position in response to a higher pressure in said second passageway than in said first mentioned passageway, and means for biasing said valve from the closed position to the open position so that said valve is located in said open position when the pressure in said second passageway is approximately equal to the pressure in said first mentioned passageway.

* * * * *